United States Patent [19]

Nee

[11] Patent Number: 4,733,419

[45] Date of Patent: Mar. 29, 1988

[54] TOILET SEAT-UP INDICATOR

[76] Inventor: Suzanne Nee, 500 N. Metro Blvd, 2067M, Chandler, Ariz. 85226

[21] Appl. No.: 66,217

[22] Filed: Jun. 25, 1987

[51] Int. Cl.[4] ..... A47K 13/00; A47K 17/00

[52] U.S. Cl. ..... 4/661; 4/234; 4/237; 4/314; 340/573; 340/686

[58] Field of Search ..... 4/661, 314, 300, DIG. 6, 4/237, 686, 238, 234; 340/569, 545, 573

[56] References Cited

U.S. PATENT DOCUMENTS

| | | | |
|---|---|---|---|
| 3,295,124 | 12/1966 | Burlason et al. | 340/569 |
| 3,611,333 | 10/1971 | Conigliaro | 340/545 |
| 3,900,908 | 8/1975 | Stump | 4/213 |
| 3,955,183 | 5/1976 | McBrain | 340/568 |
| 4,413,364 | 11/1983 | Bittaker et al. | 4/DIG. 6 |
| 4,521,919 | 6/1985 | Molloy | 4/300 X |

*Primary Examiner*—Henry K. Artis
*Attorney, Agent, or Firm*—Robert M. Skolnik

[57] ABSTRACT

A toilet seat up indicator is housed in a flat curvilinear shaped housing for fitting underneath the rim of a toilet seat. The housing contains compartments for a flashing light, batteries, an integrated circuit flasher, a mercury switch and capacitors. A cover bearing a message such as SEAT UP is slidably mounted on the housing in mounting slots over the flashing light. The mercury switch activates the flasher when the seat is up.

6 Claims, 4 Drawing Figures

TOILET SEAT-UP INDICATOR

BACKGROUND OF THE INVENTION

1. Field of the Invention

This invention relates to an indicator with attached to the underside of a toilet seat and which activates when the seat is moved to its upright position.

2. Description of Related Art

Burleson et al, U.S. Pat. No. 3,295,124 discloses a mail box which provides an audible and visual indication when mail is inserted or removed. Switches 112, and 114 are provided to indicate when the upper or lower sections of the mailbox are opened.

Conigliaro, U.S. Pat. No. 3,611,333 shows a mail box signalling system using a radio transmitter from the mail box to the house. A switch is provided in the door to indicate that the mail box has been opened.

Stump, U.S. Pat. No. 3,900,908 discloses a toilet seat with a switch for actuating a ventilation system when the seat is raised and for terminating the ventilation when the seat is lowered.

McBrian, U.S. Pat. No. 3,955,183 teaches an alarm circuit and tester therefor which is useable in a number of different alarm applications.

Bittaker et al, U.S. Pat. No. 4,413,364 relates to a toilet light unit using a battery powered lamp mounted on the top rear of the bowl controlled by a mercury switch on the seat. The light is illuminated when the seat is up.

Molloy, U.S. Pat. No. 4,521,919 discloses a ratio that is activated by a toilet seat cover. A pressure sensitive switch 48 senses the position of the seat.

Steers et al, U.S. Pat. No. 4,528,558 teaches an alarm with a delay for a refrigerator door with the alarm employing a thermal delay element in the circuit.

SUMMARY OF THE INVENTION

This invention relates to toilet seats and to the provision of a visible indication to the observer alerting the observer that the toilet seat is in the upright position.

In many situations, embarrassment has resulted from the failure to observe the position of the toilet seat as to whether the toilet seat is in the upright or the down position. The present invention is a solution to that problem in that it provides a battery operated flasher circuit mounted in a lightweight package which can be affixed directly onto the underside of the seat by adhesive, VELCRO fastening, etc. The circuitry includes a mercury switch which is mounted to deactivate the flasher when the seat is down and to activate the flasher when the seat is up.

The housing contains compartments for mounting the batteries, flashing light and electronic components within it such that the flashing light is mounted in a compartment beneath a semi-transparent cover plate which may contain a message imprinted thereon such as SEAT Up so that the message is illuminated and is contrasting with the background of the remainder of the cover plate.

The housing may be configured in a semi-circular or elliptical shape which matches the shape of the inner rim or surface of the toilet seat. Because the device fits under the seat, there is no inteference with the normal use of the seat.

A suitable adhesive is formed on the back of the housing to permit the device to be removably affixed to the underside of the toilet seat.

The circuitry employed includes a flasher circuit employing a mercury switch. When the seat is in an upright or vertical position, the switch will close causing a light to flash at approximately 1 Hz frequency. The circuit is an LM3909 LED flasher employing an oscillator integrated circuit, two tuning capacitors, batteries and the mercury switch. When the seat is down (horizotal), the switch opens and the flashing stops.

The principal object of my invention is the provision of an indicator to provide a warning to an observer that the toilet seat is up. Another object of the invention is the provision of a device which can be affixed to the inside of a toilet seat and which will emit a flashing signal when the seat is up. A further object of the invention is the provision of a seat up warning indicator which can be removably affixed to the inside upper rim of the toilet seat. A still further object of the invention is the provision of a device having a housing configured to match the shape of the inside rim of the toilet seat.

Another object of the invention is the provision of a device which provides a flashing indication which is battery operated.

BRIEF DESCRIPTION OF THE DRAWINGS

These as well as further objects and advantages of the invention will become apparent to those skilled in the art from a review of the accompanying detailed description of the invention reference being made to the accompanying drawings in which.

DESCRIPTION OF THE PREFERRED EMBODIMENTS

Figures 1, 1A:
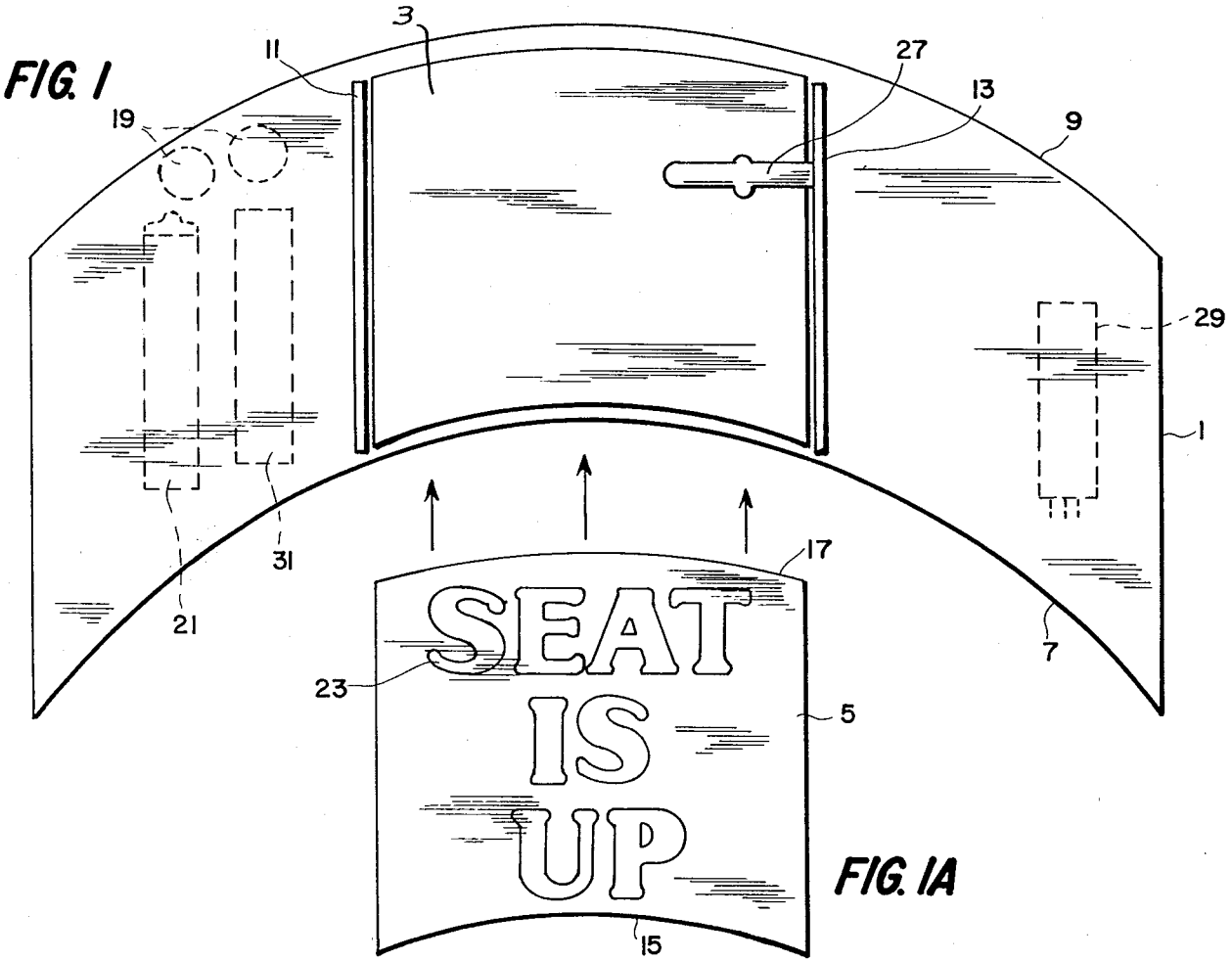
FIG. 1 is a front view of the invention.
FIG. 1A is a front view of the cover portion of the device of FIG. 1.

FIG. 1 is a front view of the device of my invention. The housing 1 is formed of suitable material such as plastic or polystyrene the only requirement being that the housing be of relatively light weight and be flat but of sufficient mechanical strength to support the circuit elements and batteries described below. The housing may be formed with circular top and bottom surfaces 9 and 7 respectively which shaped matches the interior surface of the bottom of a toilet seat. Housing 1 has a central front facing aperture 3 formed therein. The flashing light 27 protrudes into a portion of aperture 3.

The cover 5 shown in FIG. 1A overfits aperture 3 and bulb 27. More particularly, FIG. 1A shows a cover portion 5 having a message 23 inscribed thereon. The message of FIG. 1A is "SEAT IS UP". The message 23 is formed such that it is visible and stands out against the background portion of the remainder of cover 5. If desired, cover 5 has lower surface 15 and upper surface 17 formed of a curvilinear shape complementary with the shape of housing 1 at surfaces 7 and 9.

Cover 5 is slidably mounted over aperture 3 via mounting slots 11 and 13 formed in houisng 1 adjacent to aperture 3.

Additional compartments are provided in housing 1 to carry batteries 19, integrated circuit 31, capacitors 29 and mercury switch 21. Suitable adhesive 25 is formed on the back surface of housing 1 to enable the housing to adhere to the inner surface of the toilet seat.

Figure 2:
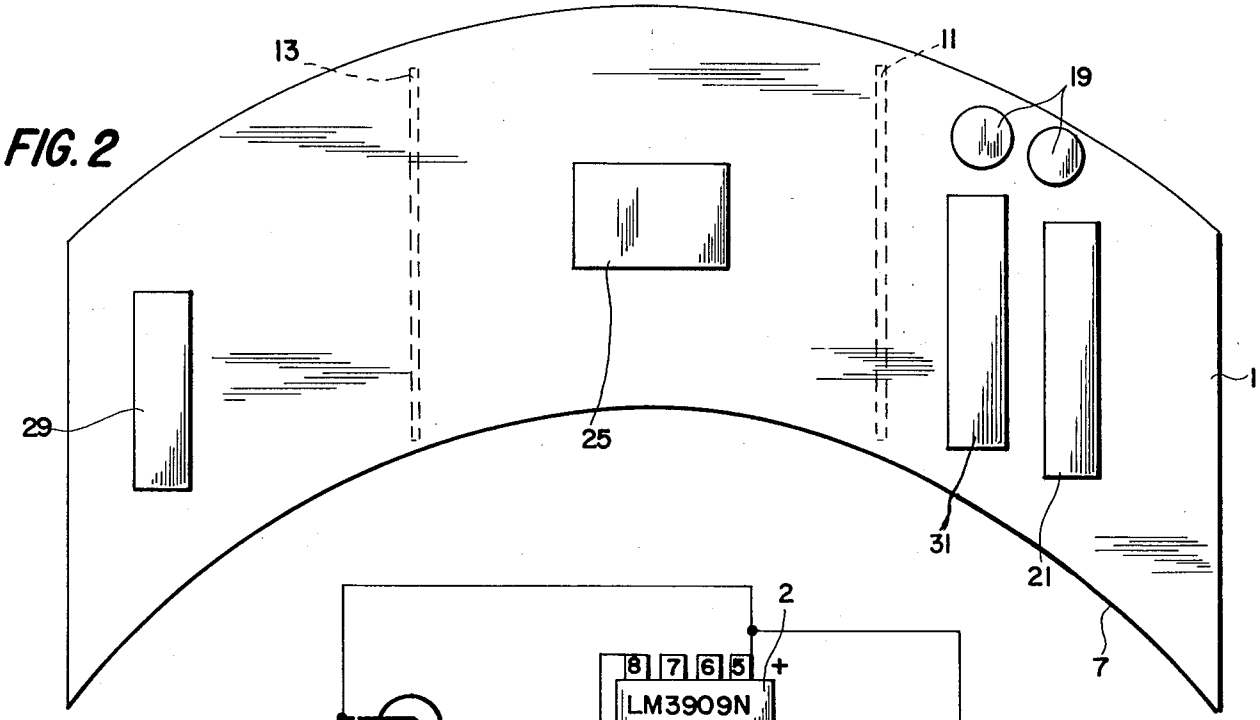
FIG. 2 is a back view of the invention.
Figure 3:
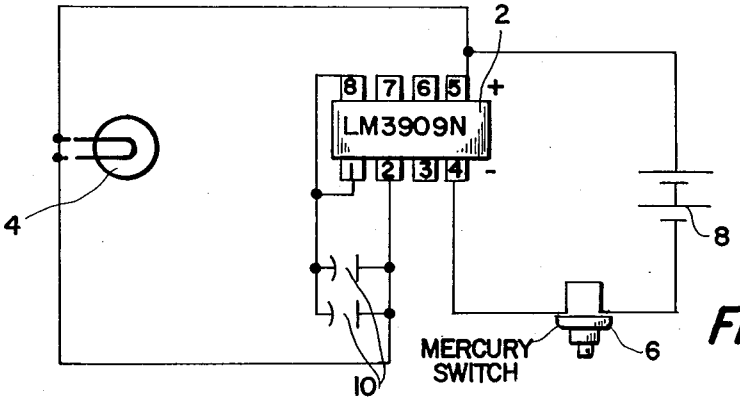
FIG. 3 is a schematic diagram of the flasher circuit employed in the invention.

FIG. 2 is a schematic diagram of the lamp flasher circuit which is employed in the invention. The lamp 4 is connected across an integrated circuit oscillator 2 which oscillator is controlled via capacitors 10. Mercury switch 6 is conected in series between the oscillator 2 and a battery power supply 8. When the mercury switch closes, the power is completed to the oscillator and the flashing of lamp 4 commences.

As modifications to the foregoing may be made without department from the spirit and scope of my invention, the subject matter for which I desire the protection of a United States Patent is set forth in the appended claims.

I claim:

1. A device for providing a visible indication that a toilet seat is in its vertical position comprising:

a housing having an upper edge surface and a lower edge surface;

a first compartment formed in said housing, said compartment having a source of light mounted therein;

a cover plate overfitting said housing and said light source, said cover plate having a message formed thereon;

a second compartment formed in said housing;

electronic circuit means mounted in said second copartment, said circuit means being connected to said light source for controlling the actuation of said light source;

position sensing means connected to said circuit means for selectively applying power to said circuit means as a function of position;

means to affix said housing to the interior surface of a toilet seat; said upper edge surface and said lower edge surface being curvilinear in shape.

2. The device of claim 1 wherein said housing's curvilinear top and bottom surfaces enable the mounting of said housing on the interior surface of a toilet seat.

3. The device of claim 2 wherein said cover plate is formed having curvilinear top and bottom edge surfaces.

4. A device for producing a visible indication when the device changes from a horizontal to a vertical position comprising:

a housing:

indicator means mounted in said housing;

position sensing means mounted in said housing and connected to said indicator means for selectively actuating said indicator means;

power supply means mounted in said housing, said power supply means being connected to said indicator means and to said position sensing means;

means for mounting said housing on another structure to sense a change in position of said structure, said housing having curvilinear upper and lower outer surfaces for mounting said housing on said structure; and a cover portion overfitting said indicator means, said cover portion having indicia imprinted thereon.

5. The device of claim 4 further including means formed in said housing adjacent said indicator means for removably mounting said cover portion over said indicator means.

6. The device of claim 4 wherein said cover portion has upper and lower edge surfaces formed thereon having curvilinear shapes complementary to the shapes of the surfaces of said housing.

* * * * *